United States Patent [19]

Le Pierres

[11] 4,419,922

[45] Dec. 13, 1983

[54] RECOIL CUSHIONING DEVICE, PARTICULARLY FOR QUICK-FIRING WEAPONS

[75] Inventor: Gildas Le Pierres, Boutigny-sur-Essone, France

[73] Assignee: Vibrachoc, Saint Cloud, France

[21] Appl. No.: 241,615

[22] Filed: Mar. 9, 1981

[30] Foreign Application Priority Data

Mar. 12, 1980 [FR] France ..... 80 05490

[51] Int. Cl.[3] ..... F41F 19/14

[52] U.S. Cl. ..... 89/43 R; 89/44 A

[58] Field of Search ..... 89/37 GM, 43 R, 44 R, 89/44 A, 177, 178, 198; 267/8 R, 22 A, 33, 34, 35

[56] References Cited

U.S. PATENT DOCUMENTS

| | | | |
|---|---|---|---|
| 442,919 | 12/1890 | Schneider | 89/44 R |
| 2,269,297 | 1/1942 | White | 89/37 GM |
| 2,318,437 | 5/1943 | Vickers | 89/43 R |
| 2,454,818 | 11/1948 | Lucht | 89/44 R |
| 4,016,799 | 4/1977 | Le Pierres | 89/44 R |
| 4,318,535 | 3/1982 | Imai | 267/34 |

OTHER PUBLICATIONS

Melvin M. Johnson, Jr., Automatic Weapons of the World, "Heavy Machine Guns", Automatic Guns, Maxim Models, 1946, pp. 91–96.

*Primary Examiner*—Stephen C. Bentley

*Attorney, Agent, or Firm*—Larson and Taylor

[57] ABSTRACT

The recoil cushioning device comprises a recoiling member guided in a fixed member with cushioning means comprising a constant volume chamber placed between two diaphragms, said chamber being subdivided into three areas separated by constrictions. A recovery spring is compressed during recoil. When the recoil amplitude is adequate a bearing surface is applied against a cushion, which increases rigidity.

10 Claims, 2 Drawing Figures

RECOIL CUSHIONING DEVICE, PARTICULARLY FOR QUICK-FIRING WEAPONS

Figure 1:
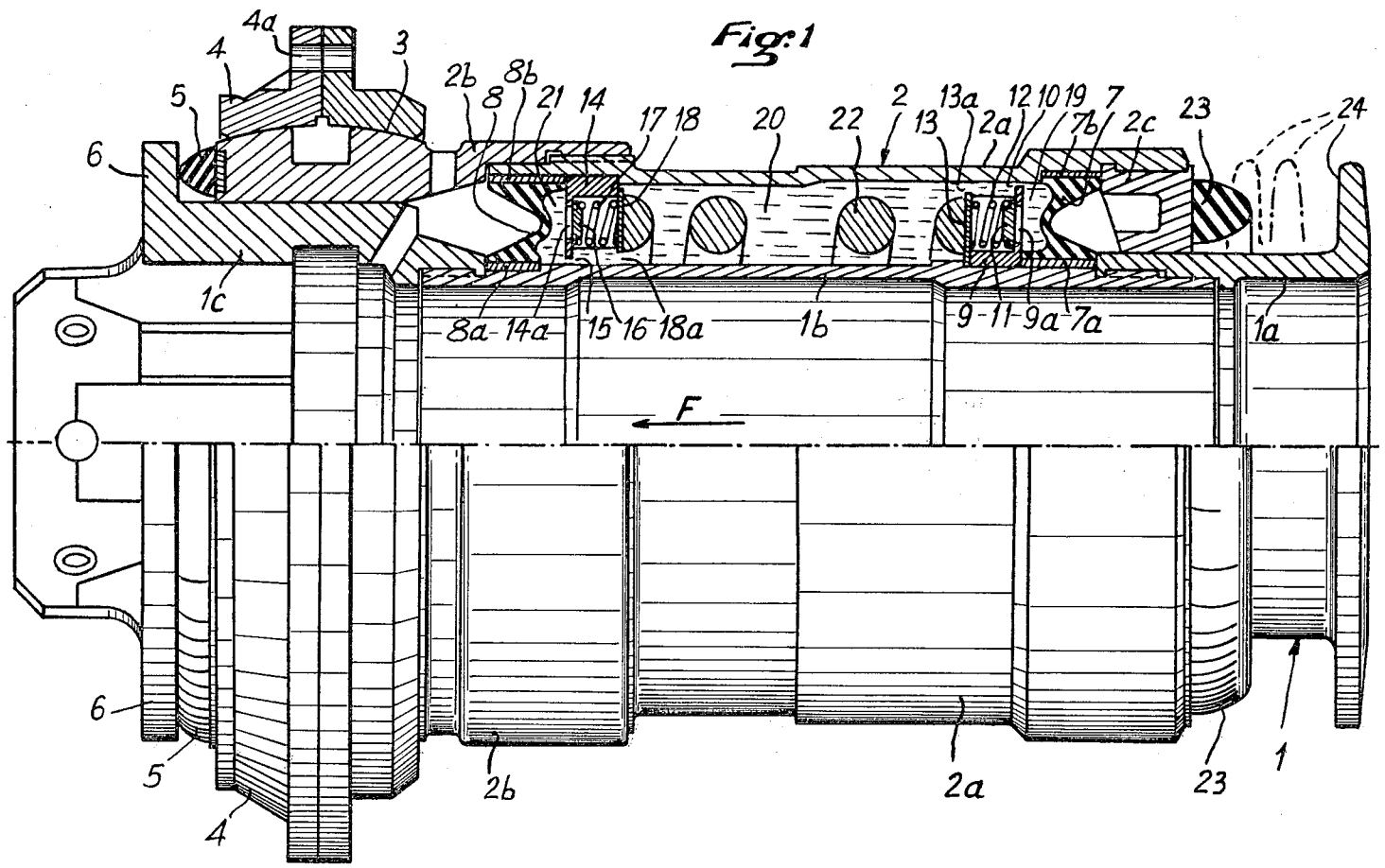

The present invention relates to a recoil cushioning device, particularly for quick-firing weapons, e.g. guns used on aircraft.

It is known that automatic weapons, particularly those fitted to aircraft having, for example, a calibre of 30 are now being designed to fire at increasingly high speeds. Simultaneously, the initial speed of the projectiles tends to increase. As a result, the weapon-carrying structures are subject to ever higher stresses and strains which, in the case of an aircraft, can only be compensated by reinforcing the structure, which must remain as light as possible.

Recoil cushioning devices for positioning between the weapon and the structure are known, particularly in the case of aircraft. Such devices have an effective cushioning action, so that the stress applied to the structure is distributed in time and has no excessive instantaneous amplitude. In particular, the cushioning device described in French Patent No. 7,106,918 makes it possible to exert on the moving part of the weapon a braking force or pull, which is only transmitted to the structure during the recoil phase, but which is suppressed during the position return phase. However, despite their excellent characteristics, such cushioning devices have the disadvantage of being complex, heavy and of large dimensions. Moreover, their rigidity is not adapted in an optimum manner to conditions of operation at different speeds, whilst modern tendencies are increasingly towards providing weapons which have at least two different firing rates.

The present invention proposes to obviate these disadvantages and provide a recoil cushioning device of simple and economic design, with limited weight and overall dimensions and which makes it possible to cushion, under other optimum conditions and in particular with a minimum displacement, the stresses and stresses corresponding to very high, but differing firing rates.

The present invention therefore relates to a recoil cushioning device, particularly for quick-firing automatic weapons, located between a recoiling part of the weapon and a fixed part which guides the recoiling part, of the type exerting a cushioning force on the recoiling part during the recoil movement and exerting no cushioning force during the return movement, wherein it comprises cushioning means able to cushion the recoiling part during any portion of the recoil travel, said means being associated with first elastic recovery means for having a first rigidity for a first firing rate and second elastic recovery means which are only operated when the recoil amplitude exceeds a certain value and having an elasticity permitting them, in conjunction with the other means, to have a second higher rigidity corresponding to a second higher firing rate.

According to a preferred embodiment of the invention, the said cushioning means comprise, between the fixed part and the recoiling part, a preferably annular chamber, sealed at its front and rear ends by sealing members enabling the chamber to retain its volume during the movements of the recoiling part, said chamber being subdivided by a first partition fixed to the recoiling part and a second partition fixed to the fixed part into three areas, namely a front area, an intermediate area and a rear area, which are filled with a cushioning fluid. The intermediate area can be connected to the two other areas, during the recoil movement which reduces the value of said intermediate area by constrictions and during the return movement which increases its value can be connected to said areas by wide passages. The second elastic means comprise at least one elastic and preferably elastomer cushion, placed between the recoiling member and the fixed member so as to be compressed therebetween when the recoil amplitude becomes sufficiently high to ensure that said cushion, carried by one of these members, comes into contact with a compression surface carried by the other member.

According to other embodiments of the invention the chamber can be divided up in some other way, for example into two areas, whose simultaneous variations compensate one another.

Within the meaning of the present invention, the firing rates are at least 500 rounds per minute and preferably, for the first firing rate, approximately 1100 rounds per minute and for the second firing rate approximately 1800 rounds per minute.

The sealing means sealing the front and rear ends of the chamber are preferably diaphragms made from a deformable elastomer adhering both to the fixed member and to the recoiling member. As a result of the fact that in the preferred embodiment during the recoil movement the areas defined by the said diaphragms tend to increase and receive excess liquid passing through the constriction openings, the diaphragms are exposed to very small compression stresses. These stresses remain low during the return movement because, outside these areas, discharge takes place by wide passages towards the intermediate area.

If appropriate, the diaphragms can be replaced by sliding gaskets due to the limited pressure to which said gaskets are exposed.

In order to reduce the overall dimensions, the first recovery means can comprise a helical recovery spring positioned within the intermediate area and bearing at its two ends on the walls separating the intermediate area from the front and rear areas.

Preferably, the orientation ball joint of the device is placed on the fixed member so as to cooperate with a corresponding bearing surface on the structure.

Figure 2:
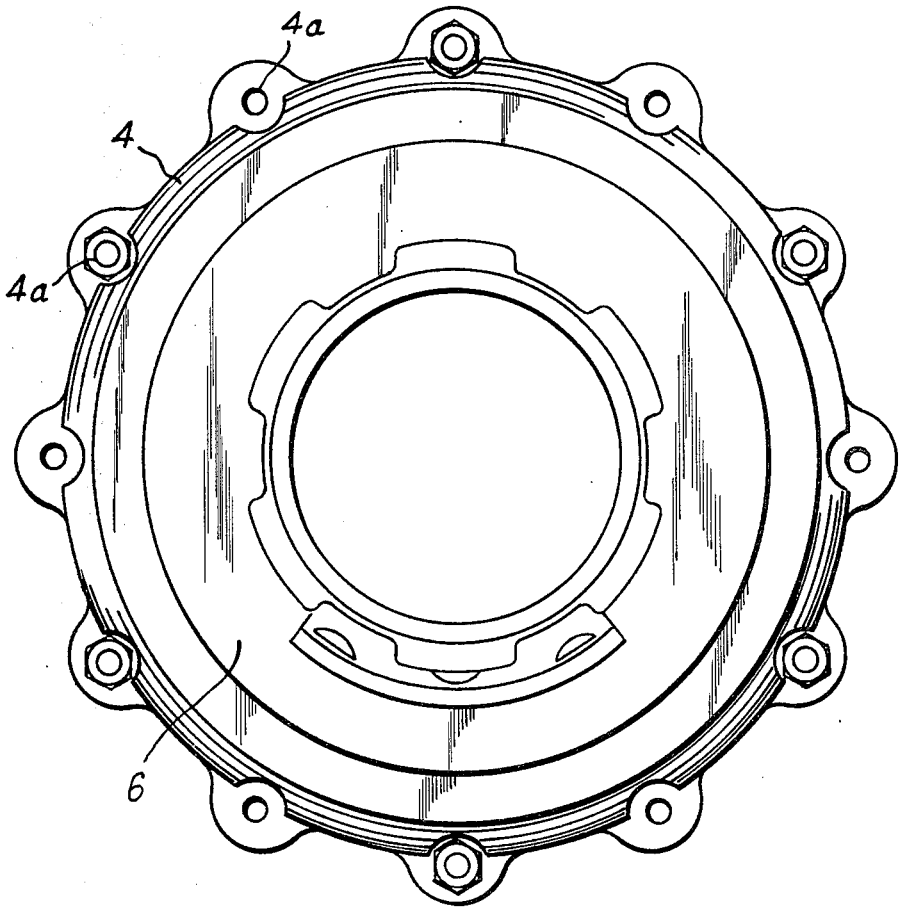

Other advantages and characteristics of the invention can be gathered from the following description of a non-limitative embodiment and with reference to the attached drawings, wherein show: FIG. 1 an elevation with a half-section of a recoil cushioning device according to the invention. FIG. 2 a left profile view of this cushioning device.

FIGS. 1 and 2 show a recoil cushioning device intended for a calibre 30 gun to be carried by an aircraft and constructed so as to operate with two firing rates, a lower rate of 1100 rounds per minute and a higher rate of 1800 rounds per minute.

It can be seen that member 1 or the recoiling part of the weapon is constituted by three consecutive cylindrical portions 1*a*, 1*b*, 1*c*, said member sliding within the fixed member 2 constituted by a first substantially cylindrical portion 2*a* and a second consecutive portion 2*b*. Arrow F indicates the recoil movement direction. The recoiling member 1 is guided in fixed member 2 by means of an internal bearing surface of a fixed portion 2*c* shaped like a ring with a U-shaped cross-section open towards the rear and fixed to the rear portion of fixed member 2 in order to permit the sliding and guidance of the outer surface of portion 1*a* of the recoiling member.

Guidance is also ensured by the inner bearing surface of the rear portion of member 2b permitting the guidance and sliding of the outer surface of portion 1c. Moreover, said rear portion of member 2b has a spherical surface 3 shaped like a ball joint able to cooperate with an internal spherical bearing surface of an annular part 4 provided with a plurality of openings 4a permitting the screwing of annular part 4 onto the structure and to a certain extent it forms part thereof. The trailing edge of member 2b also carries an annular elastomer cushion 5 which adheres to the said edge and against which can abut a shoulder 6 terminating the portion 1c from the rear. In this way, a safety cushioning is formed with respect to the end of the return movement to the front position of recoiling member 1.

As can be gathered from the drawings, the external diameter of member 1 in portion 1b is slightly less than the internal diameter of member 2 in portion 2a, so that an elongated annular space is defined between members 1 and 2. This space forms an annular chamber defined in its front portion by an elastomer diaphragm 7 which has, as can be seen in FIG. 1, in the rest position a curvature permitting an adequate deformation of the diaphragm. The internal periphery of diaphragm 7 adheres to a ring 7a, locked onto portion 1b, whilst the outer peripheral surface of diaphragm 7 adheres to a ring 7b, locked against the inner face of the fixed portion 2a.

In a symmetrical manner, the rear end of the chamber is sealed by a rear diaphragm 8, similar to diaphragm 7 and adhered to two rings, specifically an internal ring 8a fixed to portion 1b and an external ring 8b fixed to the fixed portion 2a. The chamber defined in this way between diaphragms 7 and 8 has a constant volume, no matter what the relative axial position between member 1 and member 2 during the recoil movement or the return movement. The thickness and nature of the elastomer forming diaphragm 7a are determined in such a way that the deformation of said diaphragms during recoil and return only leads to a limited elastic resistance and a limited internal cushioning.

Within the tight chamber defined in this way, the recoiling portion 1b carries a circular part 9 with a right-angled cross-section, whose base is fixed to portion 1b and whose radial branch forms, within the chamber, a separating wall extending up to the vicinity of the internal surface of portion 2a in order to form, between said surface and said branch, a small constricting passage 10. The branch or radial portion of part 9 also has a plurality of angularly spaced orifices 9a which can be sealed by a non-return valve 11 moved back into the closed position by a weak spring 12, which bears on a washer 13 locked against portion 1b and provided with wide passages 13a.

In a similar manner on the side of diaphragm 8, portion 2a has an annular part 14 with a right-angled cross-section defining a narrow constricting passage 15 between the end of its branch and the outer surface of portion 1b. This branch has non-return valves 16 facing its orifices 14a. The valve is moved back into its closed position by a spring 17 bearing on a washer 18 leaving a wide passage 18a and fixed to portions 2a.

The walls formed by the radial branches of annular parts 9, 14 thus subdivide the chamber into three areas, namely a front area 19 extending between part 9 and diaphragm 7, an intermediate area 20 extending between the two parts 9 and 14 and a rear area 21 extending between part 14 and rear diaphragm 8. Within the intermediate area 20, a strong recovery spring 22 bears on the one hand against the front washer 13 and on the other against the rear washer 18. The three volumes defined in this way in the chamber are completely filled with a cushioning oil with a viscosity which is preferably between 100 and 500,000 centistokes.

The second elastic means comprise an elastomer cushion 23 carried by the front face of portion 2c and against which can be applied a peripheral shoulder 24 carried by portion 1a as from the time when the recoil has reached such an amplitude that it permits shoulder 24 to come into contact with 23.

Operation takes place in the following manner. As from the rest position shown in FIG. 1, a burst is fired at a rate of 1100 rounds per minute. The recoil movement in the direction of arrow F of member 1 within fixed member 2 brings the annular part 9 close to annular part 14, which remains fixed. Thus, the intermediate area 20 will decrease. The resulting pressure increase in chamber 20 leads to oil being expelled through the constricting passages 10 and 15 towards chamber 19 and 21, whose total volume increase precisely compensates the reduction of area 20. During this time, valve 11 and 16 are hermetically sealed by the overpressure in intermediate chamber 20. The constriction of the oil through the narrow passages 10 and 15 leads to an intense cushioning action up to the end of the recoil movement, the braking force being transmitted to member 2.

During this time, recovery spring 22 is compressed firstly alone and then when shoulder 24 has come into contact with cushion 23 continues to compress, in the same way as cushion 23, up to the rear dead centre.

At the end of the recoil movement, the recovery spring 22 and the cushion 23 are decompressed and on this occasion move member 1 forwards. As a result, area 20 tends to increase and areas 19 and 20 to decrease, which brings about an inversion of the pressure difference between the areas and consequently the immediate openings of valves 11 and 15 and the rapid passage of oil from areas 29 and 21 to area 20, with only a minimum increase in the pressure in the two latter areas. Thus, during the return movement braking is substantially zero and its low value is mainly due to the cushioning caused by the deformation of diaphragms 7 and 8.

The second burst is fired during this advance movement after shoulder 24 has moved well away from cushion 23. This leads to a further recoil having a lesser amplitude and leading to little or no contact with cushion 23. During the remainder of the burst, member 1 oscillates round the median position shown by dot-dash lines in the drawing, cushioning occurring during each recoil phase.

For example, a vibration isolator designed in this way with, in the inoperative position, a 20 mm spacing between cushion 23 and shoulder 24 has a rigidity of approximately 25 daN/mm for an average recoil distance of approximately 14 mm.

On firing a burst at 1800 rounds per minute instead of 1100 the recoil movement assumes an average amplitude of 22 mm, which is sufficient for shoulder 24 to deform cushion 23 throughout the complete burst. As the device is designed in such a way that the oscillation of member 1 in member 2 during the burst takes place in the zone in which shoulder 24 is in contact with cushion 23, it is readily apparent that the rigidity is increased. The overall rigidity during this high speed burst is then 65 daN/mm.

Although the invention has been described relative to a particular embodiment, it is obviously not limited thereto and various modifications can be made thereto without passing beyond the scope of the invention.

Thus, diaphragms 7 and 8 could be replaced by sliding gaskets, for example gaskets carried by member 2 and sliding on the outer surface of member 1 or vice versa, the low pressure in the front area 19 and rear area 21 being sufficiently low to permit such a solution.

Furthermore, the elastomer cushions and in particular cushion 23 could be replaced by cushions of some other type, for example made from knitted metal wire.

In addition, partitions 9, 14 could be reversed in such a way that the intermediate area increases during recoil and receives the constricted liquid displaced from the outer areas whose size decreases. Alternatively, the chamber could be divided into two instead of three areas. These solutions have the disadvantage of establishing a high pressure on the gaskets such as 7 or 8.

I claim:

1. A recoil cushioning device, for quickfiring automatic weapons adapted to be operated at two different firing rates, located between a recoiling part of the weapon and a fixed part which guides the recoiling part, of the type exerting a cushioning force on the recoiling part during the recoil movement and exerting no substantial cushioning force during the return movement, wherein it comprises cushioning means for cushioning the recoiling part during any portion of the recoil travel, said cushioning means being associated with a first elastic recovery means having a first rigidity during the recoils of and being operative during the oscillation of said recoiling part corresponding to a first firing rate and second elastic recovery means which are only operated when the recoil amplitude exceeds a certain value and having an elasticity permitting them, in conjunction with said elastic recovery means, to secure a second higher rigidity during oscillation of said recoiling part corresponding to the recoils of a second higher firing rate wherein the cushioning means comprises, between the fixed part and the recoiling part, a chamber sealed at its front and rear ends by sealing members permitting the chamber to retain its volume during the movements of said recoiling part, said chamber being subdivided into at least two areas, whereof one is reduced in complementary manner to the increase of the other area during recoil, so as to pass a cushioning fluid from one area to the other via constricting passages, and wherein the chamber is subdivided by a first partition fixed to the recoiling part and a second partition fixed to the fixed part into three areas, namely a front area, an intermediate area and a rear area, filled with a cushioning fluid, the intermediate area being linked with the two other areas during the recoil movement which reduces the size of said intermediate area, by constricting passages whereas during the return movement which increases its size, said intermediate area can be connected with the other areas by wide passages.

2. A recoil cushioning device according to claim 1, wherein the second recovery means comprise at least one elastic cushion placed between the recoiling part and the fixed part, so that it is compressed between them when the recoil amplitude increases sufficiently to make said cushion come into contact with a compression surface.

3. A recoil cushioning device according to claim 1 wherein the sealing means sealing the front and rear ends of the chamber are deformable elastomer diaphragms, which adhere both to the fixed part and to the recoiling part.

4. A recoil cushioning device according to claim 1, wherein the first recovery means comprise a helical recovery spring positioned within the intermediate area.

5. A recoil cushioning device according to claim 1 wherein the rigidity of the first recovery means is approximately 25 daN/mm, and the rigidity of the first and second recovery means together is approximately 65 daN/mm.

6. A recoil cushioning device according to claim 1 wherein the fixed part carries a ball joint cooperating with a corresponding bearing surface on the structure.

7. A recoil cushioning device according to claim 2 wherein the first recovery means comprise a helical recovery spring positioned within the intermediate area.

8. A recoil cushioning device for quick-firing automatic weapons, located between a recoiling part of the weapon and a fixed part which guides the recoiling part, comprising cushioning means for cushioning the recoiling part during any portion of the recoil travel but exerting no substantial cushioning force during the return movement, said cushioning means comprising a chamber sealed at its front and rear ends by sealing members permitting the chamber to retain its volume during the movements of the recoiling part, wherein the chamber is subdivided by a first partition fixed to the recoiling part and a second partition fixed to the fixed part into three areas, namely a front area, an intermediate area and a rear area, filled with a cushioning fluid, the intermediate area being linked with the two other areas during the recoil movement, which reduces the size of said intermediate area, by constricting passages whereas during the return movement which increases its size said intermediate area can be connected with the other areas by wide passages, said cushioning means being associated with first elastic recovery means for having a first rigidity during the recoils of a first firing rate and second elastic recovery means which are only operated when the recoil amplitude exceeds a certain value and having an elasticity permitting them, in conjunction with said first means to secure a second higher rigidity during the recoils of a second higher firing rate.

9. A recoil cushioning device according to claim 8, wherein the second recovery means comprise at least one elastic cushion placed between the recoiling part and the fixed part, so that it is compressed between them when the recoil amplitude increases sufficiently to make said cushion come into contact with a compression surface.

10. A recoil cushioning device according to claim 9 wherein the first recovery means comprise a helical recovery spring positioned within the intermediate area.

* * * * *